US008708869B2

(12) United States Patent
Drechsler

(10) Patent No.: US 8,708,869 B2
(45) Date of Patent: Apr. 29, 2014

(54) DYNAMIC RESISTANCE TRAINING MACHINE

(76) Inventor: Arthur J Drechsler, Flushing, NY (US)

( * ) Notice: Subject to any disclaimer, the term of this patent is extended or adjusted under 35 U.S.C. 154(b) by 296 days.

(21) Appl. No.: 13/317,199

(22) Filed: Oct. 12, 2011

(65) Prior Publication Data

US 2012/0252643 A1 Oct. 4, 2012

Related U.S. Application Data

(63) Continuation-in-part of application No. 13/065,783, filed on Mar. 30, 2011.

(60) Provisional application No. 61/571,968, filed on Jul. 8, 2011.

(51) Int. Cl.
*A63B 21/00* (2006.01)

(52) U.S. Cl.
USPC ..... 482/93; 482/104; 482/106

(58) Field of Classification Search
USPC ..... 482/104, 106, 135, 98
See application file for complete search history.

(56) References Cited

U.S. PATENT DOCUMENTS

| | | | | | |
|---|---|---|---|---|---|
| 4,220,327 | A * | 9/1980 | Herbowy | ..... | 482/44 |
| 5,078,388 | A * | 1/1992 | Dempsey, Jr. | ..... | 482/49 |
| 5,451,191 | A * | 9/1995 | Beenken | ..... | 482/47 |
| 5,723,785 | A * | 3/1998 | Manning | ..... | 73/379.03 |

* cited by examiner

*Primary Examiner* — Jerome W Donnelly
(74) *Attorney, Agent, or Firm* — Tod R. Nissle, P.C.

(57) ABSTRACT

A compact portable exercise machine includes elastic resistance members which are distended or compressed by only a limited amount in order to extend the operational life of the resistance members. Although the elastic resistance members are distended only a relatively short distance during an exercise, the pulled system utilized to distend the elastic members permits a comparatively large range of motion by the individual performing the exercise. The portability of the exercise machine permits it to be readily positioned to perform a relatively large range of exercise.

5 Claims, 8 Drawing Sheets

DYNAMIC RESISTANCE TRAINING MACHINE

This application claims priority based on U.S. Provisional Patent Application Ser. No. 61/571,968 filed Jul. 8, 2011. This application also bases priority on and is a continuation-in-part of U.S. patent application Ser. No. 13/065,783 filed Mar. 30, 2011.

This invention relates to weight lifting apparatus and methods.

In a further respect, the invention relates to resistance training apparatus and methods.

In another respect, the invention relates to an improved exercise apparatus which facilitates the proper positioning of weights or resistance training apparatus with respect to the body of an individual during an exercise and which reduces the risk of injury to the individual.

In still a further respect, the invention relates to resistance training apparatus that in some applications simulates free weight exercises in which gravity provides the only material resistance.

The motivation to provide weight lifting and resistance training equipment and methodology which minimizes the risk of injury to an individual has long existed. As a result, numerous exercise equipment apparatus have been produced along with multitudes of exercise routines, and such apparatus and routines have been redesigned and analyzed over and over and over again for many decades.

Accordingly, it would be highly desirable to provide an improved exercise apparatus and methodology to reduce the risk of injury to an individual and to facilitate the use of proper technique in carrying out an exercise.

It would also be highly desirable to provide improved exercise apparatus which simulates the experience of free weights and increases the variety of exercises which an individual can perform with the exercise apparatus.

Therefore it is a principal object of the invention to provide an improved exercise apparatus and methodology.

This and other, further and more specific objects of the invention will be apparent to those skilled in the art from the following detailed description thereof, taken in conjunction with the drawings, in which.

Figure 1:
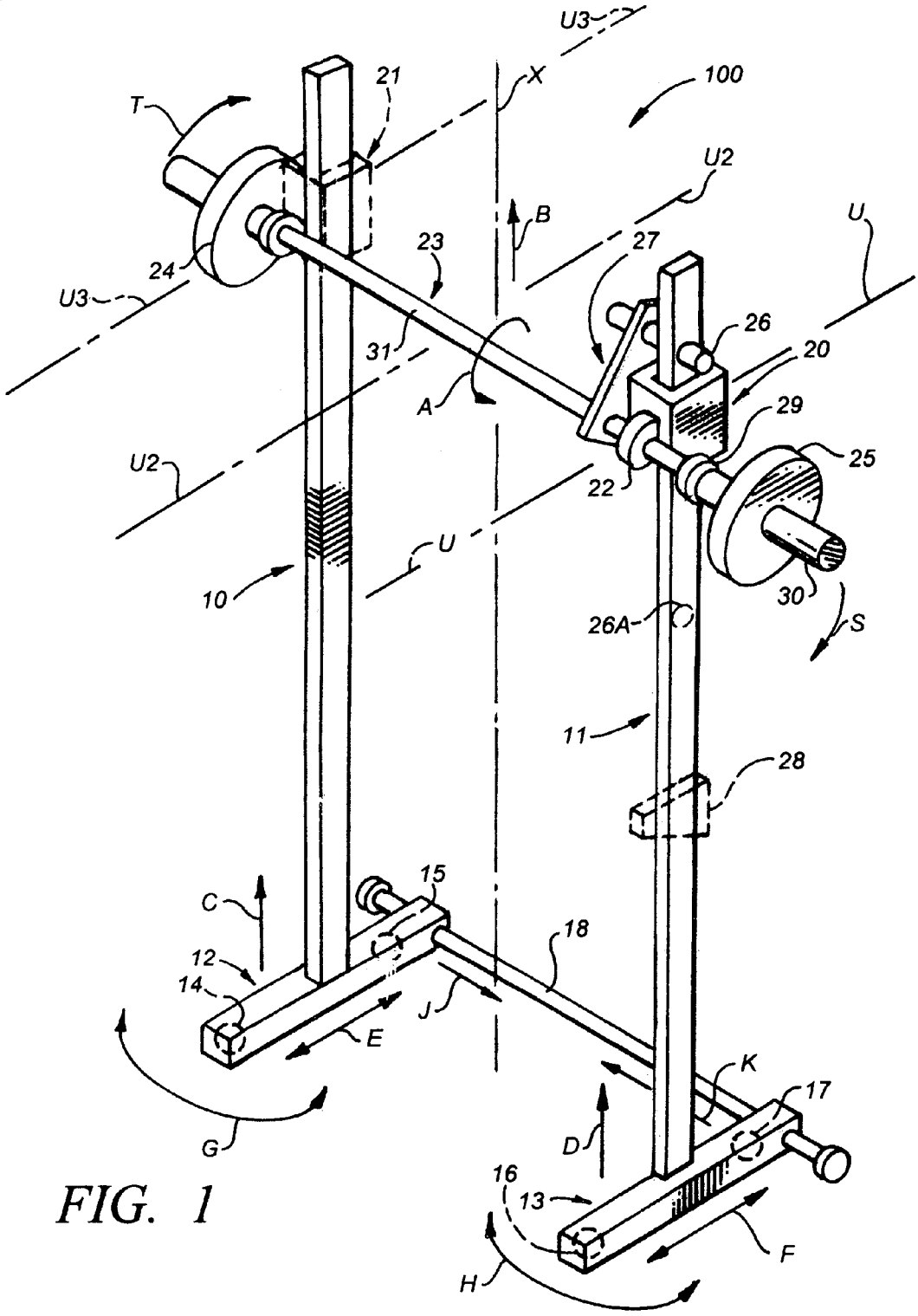
FIG. 1 is a perspective view illustrating exercise apparatus constructed in accordance with the principles of the invention.

Briefly, in accordance with the invention, I provide an improved method in which an individual dynamically positions a weight during an exercise to facilitate proper exercise technique and reduce the risk of injury. The improved method comprises the step in which the individual provides an exercise apparatus. The exercise apparatus includes a base having at least two operative positions, a first operative position with the base fixedly contacting a floor, and a second operative position with the base spaced apart from the floor and horizontally movable over the floor in any desired direction of travel. The exercise apparatus also includes a pair of spaced apart vertically oriented legs each have a lower portion attached to the base and an upper portion; at least one fixed support on the upper portion of at least one of the legs; at least one sleeve slidably mounted on at least one of the legs; a barbell extending between the vertically oriented legs and attached to the sleeve such that the barbell and sleeve slidably simultaneously move along a leg; and, stabilizing apparatus mounted on the barbell and movable between at least two operative positions, a primary operative position with the stabilizing apparatus engaging the fixed support to secure the barbell in fixed position on the legs such that the fixed support supports the weight of the barbell, and a secondary operative position with the stabilizing apparatus disengaged from the fixed support (1) to permit the sleeve and the barbell to slide up and down along the legs, and (2) such that the weight of the barbell is not supported by the fixed support. The base is in the first operative position when the stabilizing apparatus is in the primary operative position; and, is in the second operative position when the stabilizing apparatus is in the secondary operative position. The method also comprises the steps of placing the stabilizing apparatus in the primary operative position such that the base is in the first operative position and the exercise apparatus is at an initial location on the floor; moving to a position (i.e., the individual positions himself) between the legs beneath the barbell; grasping (i.e., the individual grasps) the barbell and moving the stabilizing apparatus to the secondary operative position such that the base is in the second operative position; and, performing (i.e., the individual performs) an exercise while sliding the sleeve (i.e., the individual slides the sleeve) and the barbell along said leg, and moving the exercise apparatus (i.e., the individual moves the exercise apparatus with his hands on the barbell) from said initial position on said floor to another position on said floor.

In accordance with another embodiment of the invention, I provide a method in which an individual dynamically positions resistance training apparatus during an exercise to facilitate proper exercise technique and reduce the risk of injury. The method comprises the steps in which the individual provides an exercise apparatus. The exercise apparatus includes a base fixedly positioned on a floor; at least one upstanding support member fixedly secured to the base, and, a resistance unit. The resistance unit comprises a housing. The housing includes a first stationary support; a second movable support spaced apart from the first stationary support; and, a plurality of elastic members mounted in the housing and each including a first end attached to the first stationary support and a second end attached to the second movable support. The resistance unit also comprises a rotatable shaft having a first diameter and connected to the second movable support such that rotation of the shaft displaces the second movable support member to change the length of and alter the resistance produced by the plurality of elastic members; a rotatable cylindrical spool mounted on the rotatable shaft and having a second diameter greater than the first diameter; and, a manually operable handle connected to the cylindrical spool and displaceable to rotate the spool and the shaft simultaneously to move the second movable support. The exercise apparatus also includes a mounting system interconnecting the resistance unit and support member to permit the resistance unit to move between at least two operative positions during the performance of an exercise, a first operative position with the resistance unit in a first initial orientation with respect to the support member, and a second operative position with the resistance unit in a second orientation with respect to the support member. The second orientation is different than the initial orientation.

Turning now to the drawings, which depict the presently preferred embodiments of the invention for the purpose of illustration thereof, and not by way of limitation of the invention, and in which like reference characters refer to corresponding elements throughout the several views, FIG. 1 illustrates an exercise apparatus which is constructed in accordance with the invention, is generally indicated by reference character 100, and includes a base including a pair of spaced apart feet 12 and 13. Foot 12 includes compressive elements comprising a pair of spring loaded spherical bearings 14 and 15. Foot 13 includes compressive elements comprising a pair of spring loaded bearings 16 and 17. When bearings 14 to 17 are deployed they roll freely over the floor and permit the exercise apparatus 100 to move or rotate in any desired direction. One important advantage of the invention is that it obviates the need to provide two pair of uprights or legs; one pair for pins to position or stow the barbell and another pair of uprights for the slidable sleeve(s) 20 to slide along while performing an exercise. Instead, in the apparatus of the invention, a single leg 11 can perform both functions. Another important advantage of the apparatus is the compressive elements such that when the bearings 14 to 17 are downwardly deployed in the manner described below, and the apparatus 100 is free to roll over the floor 41 in any direction permitting users to experience freedom of movement similar to that experienced with free weights. When this feature is combined with the use of stop 28, a spotting function is generated that moves continuously with the user in any direction. Since the apparatus 100 moves continuously with the user, if the user loses control and the barbell must fall toward the floor, stop 28 is there to "catch" the barbell 23. This feature of the invention is particularly important when a user is performing a bench press. If a user loses control of a barbell during a bench press, the barbell can fall on the user's chest. Each year several people die in such accidents. When apparatus 100 is utilized with a stop 28, stop 28 is continuously positioned between the barbell and a user's body. Still another important advantage of the apparatus 100 is that the freedom of movement permitted by the apparatus helps compensate and accommodate anatomical differences like different leg and arm lengths, or spine curvature to one side or the other. Exercise machines like the Smith machine assume legs and arms are the same length and can produce undue stress on one part of body.

Elongate rod 18 slidably extends through each foot 12 and 13 such that foot 12 can slide along rod 18 in the direction of arrow J toward foot 13, and such that foot 13 can slide along rod 18 in the direction of arrow K toward foot 12. Foot 12 can of course, also slide along rod 18 in a direction opposite that of arrow J, and foot 13 can also slide along rod 18 in a direction opposite that of arrow K.

The lower portion of vertically oriented leg 10 includes a lower end fixedly secured to foot 12. The lower portion of vertically oriented leg 11 includes a lower end fixedly secured to foot 13.

Barbell 23 includes bar 31. A collar 29 and rotatable sleeve 30 are mounted on each end of bar 31. Rotatable sleeve 30 and collar 29 are, in conventional fashion, free to rotate about bar 31.

Sleeve 20 is slidably mounted on the upper portion of leg 11. Barbell 23 is fixedly secured to sleeve 20 by control member 22 such that sleeve 20 and barbell 23 simultaneously slide along leg 11. Barbell 23 is, however, free to rotate in control member 22. An equivalent slidable sleeve 21 can also, if desired, be mounted on the upper portion of leg 10; and, a control member comparable to control member 22 can be used to fixedly secure barbell 23 to sleeve 21. In an alternate embodiment of the invention, control member 22 is not utilized and, instead, collar 29 is fixedly secured to sleeve 20. In FIG. 1, sleeves 20 and 21 are slidably mounted on the exterior of legs 10 and 11. As would be appreciated by those of skill in the art, each sleeve can, if legs 10 and 11 are hollow, be slidably mounted on the interior of a leg 10, 11, and can include a pin or other portion which extends from barbell 23 to the interior of leg 10, 11 (and to the sleeve on the interior of the leg) via a longitudinal slot formed along the length of the leg. Consequently, as used herein, the term sleeve applies to any member which is shaped and dimensioned to engage barbell 23 and to slide along a leg 10 and 11 simultaneously with barbell 23. The shape and dimension of a leg 10, 11 can similarly be varied as desired to engage a sleeve to permit the sleeve and barbell 23 to slide up and down along the leg.

In another embodiment of the invention, control member 22 is pivotally attached to sleeve 20 (and the comparable member attached to sleeve 21 is pivotally attached to sleeve 21) so that control member 22, and therefore bar 31, can pivot or rotate to a limited degree about an axis U (FIG. 1) that is parallel to foot 13 and that passes through control member 22 and sleeve 20. This permits bar 31 to be tilted in the manner indicated by arrows S and T (or in directions opposite arrows S and T) with respect to a horizontally oriented plane. As would be appreciated by those of skill in the art, arrows S and T lie in a common vertically oriented plane.

If, in addition to sleeve 20 and control member 22, sleeve 21 is utilized with a control member comparable to control member 22 attached to sleeve 21, then, in order for bar 31 to pivot about an axis U2, the control member attached to sleeve 21 must be able to rotate about an axis U3. Consequently, if in this configuration one sleeve 20, 21 is at a different elevation than the other sleeve, the control members 22 attached to sleeves 20 and 21 can rotate to permit bar 31 (and therefore barbell 23) to tilt in the manner indicated by arrows S and T with respect to a horizontal plane. The ability of bar 31 tilt away from a horizontal plane enables an individual to more readily compensate for differences in body make-up, including for instance a situation in which one of the individual's legs is longer than the other. Axes U, U2, and U3 are parallel.

A safety stop, indicated by dashed lines 28, can be fixedly attached to leg 11 or 10 to "catch" barbell 23 is a user loses control of barbell 23 or must lower barbell 23 toward the ground.

The apparatus of FIG. 1 includes a fixed support member in the form of a pin 26. The fixed support member can be shaped and dimensioned as desired. The fixed support member can be permanently attached to a leg 10, 11 or can, as is the case with pin 26 in FIG. 1, be slidably inserted through an aperture in leg 11 such that the member 26 can be removed and inserted in another desired aperture 26A (FIG. 1) formed along leg 11 or can otherwise be removed and placed at another desired location along leg 11.

The apparatus of FIG. 1 includes a stabilizing apparatus in the form of a bracket 27 that is fixedly mounted on barbell 23. The upper end of bracket 27 includes a slot that removably engages pin 26. When barbell 23 is grasped and rotated in the direction of arrow A, bracket 27 pivots simultaneously with barbell 23 in the direction of arrow A such that the slot in bracket 27 pivots off pin 26. When bracket 27 pivots off pin 26, barbell 23 is free to slide up and down along legs 10 and 11. Barbell 23 can slide only a short distance in the upward direction indicated by arrow B before sleeve 20 contacts pin 26. Barbell 23 can slide a greater distance in the downward direction opposite that of arrow B. In an alternate embodiment of the invention, bracket 27 is mounted on bar 31 on the opposite side of leg 11 and adjacent collar 29. If desired, a bracket comparable to bracket 27 can be included in the apparatus to be used adjacent in conjunction with sleeve 21 in the same manner that bracket 27 is utilized adjacent sleeve 20.

Figure 2:
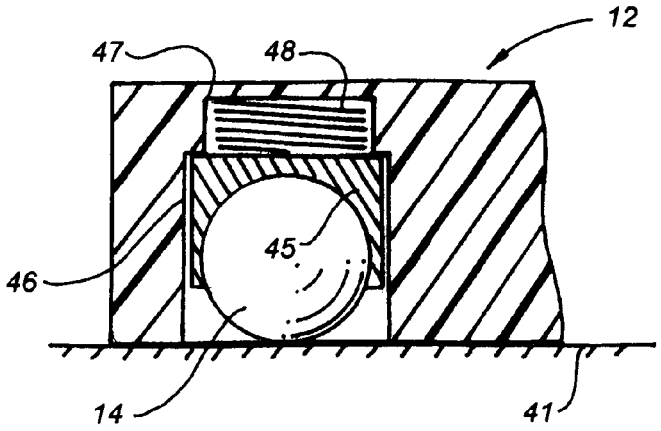
FIG. 2 is a partial section view of the apparatus of FIG. 1 illustrating additional construction details thereof.
Figure 3:
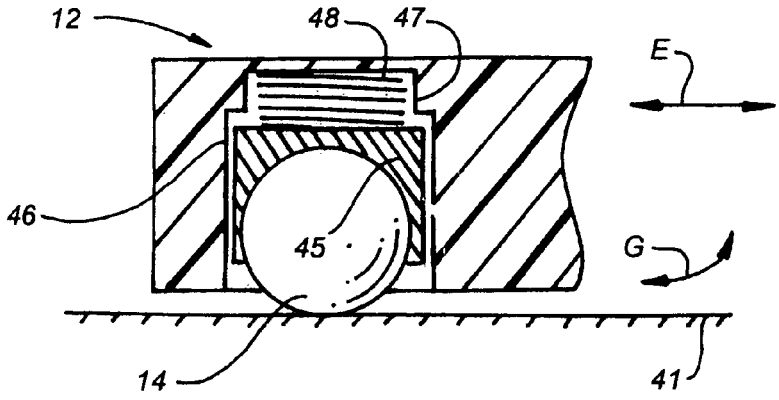
FIG. 3 is a partial section view of the apparatus of FIG. 2 illustrating the mode of operation thereof.

When bracket 27 engages pin 26 in the manner illustrated in FIG. 1, the weight of barbell 23 is borne by pin 26 and therefore base 12 and 13 and is sufficient to maintain the base 12, 13 in contact with the floor 41 in the manner illustrated in FIG. 2. This is the case because the weight of the barbell, in combination with the weight of the rest of apparatus 100, overcomes the combined expansive strength of the springs 48 operatively associated with bearings 14 to 17 and causes each bearing 14 to 17 to be pushed into it associated cylindrical aperture 46 in the manner illustrated in FIG. 2. When a bearing 14, along with its bushing—housing 43, is pushed into aperture 46, spring 48 is compressed into cylindrical aperture 47. On the other hand, when barbell 23 is rotated in the direction of arrow A to disengage bracket 27 from pin 26, the weight of barbell 23 (and any weights 24 and 25 on the barbell) is no longer borne by pin 26, in which case the combined expansive strength of the springs 28 operatively associated with each spherical bearing 14, 15, 16, 17 is sufficient to lift the apparatus upwardly in the direction of arrow B such that a portion of each spherical bearing 14 to 17 extends beneath base 12 or 13 in the manner illustrated in FIG. 3. When a portion of each spherical bearing 14 to 17 extends beneath base 12 or 13 in the manner illustrated in FIG. 3, the bearings 14 to 17 and apparatus 100 can be rolled over floor 41 in any desired horizontal direction including, without limitation, the directions indicated by arrows E. Apparatus 100 can also be pivoted about a vertical axis X in the manner indicated by arrows G and H in FIGS. 1 and 3. Since barbell 23 is a part of apparatus 100, barbell can be similarly moved in any desired horizontal direction and can be pivoted, about a vertical axis X. If it is desired to fix apparatus 100 at a particular location on floor 41, barbell 23 is lifted to the position illustrated in FIG. 1 and is rotated in a direction opposite that of arrow A to re-engage the slot in bracket 27 with pin 26. As soon as this is accomplished and pin 26, and therefore apparatus 100, is bearing the weight of barbell 23, springs 48 are overcome and base 12, 13 is downwardly displaced back into contact with the floor 41. The weight of barbell 23 and of apparatus 100 tends to generate frictional forces which make it difficult to slide base 12, 13 over floor 41 when base 12, 13 contacts floor 41 in the manner illustrated in FIG. 2.

Figure 4:
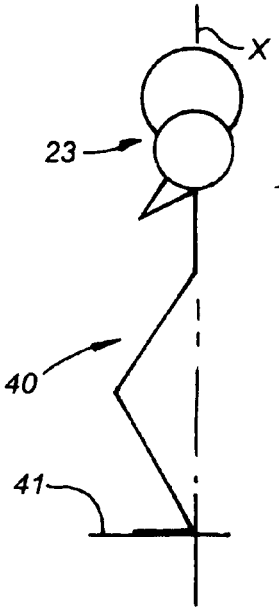
FIG. 4 is a side elevation view illustrating an individual conducting an exercise with a barbell which moves along fixed vertically oriented legs.
Figure 5:
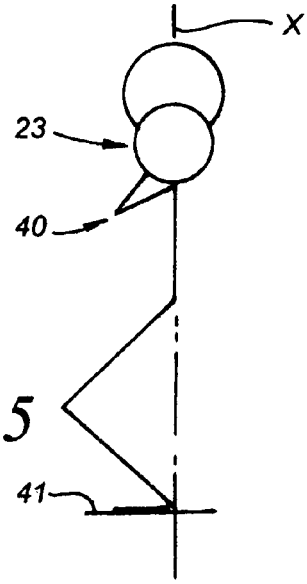
FIG. 5 is a side elevation view further illustrating an individual conducting an exercise with a barbell which moves along fixed vertically oriented legs.
Figure 6:
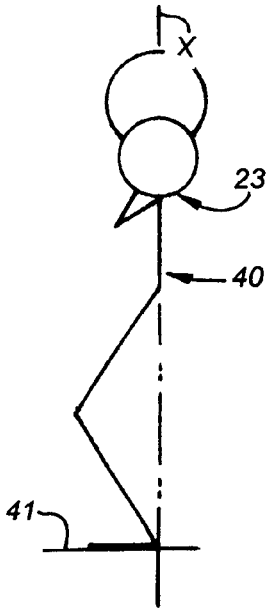
FIG. 6 is a side elevation view illustrating an individual conducting an exercise with the apparatus of FIG. 1.

In FIGS. 4 and 5, a comparable apparatus is utilized which is similar to apparatus 100 but which maintains a fixed position on floor 41. The comparable apparatus will not move, regardless of the position of the body of an individual 40. The immobility of comparable apparatus increases the risk of injury, particularly with heavier weights, because the optimal position of barbell 23 varies with respect to an individual's build and with respect to the position of the individual at varying points during an exercise. In contrast, as is described below with respect to FIGS. 6 and 7, the apparatus 100 of the invention is readily moved to optimal positions during an exercise by an individual.

The apparatus of FIG. 1 also permits a more compact design since the collar 20, bracket 27 and catch 28 are on a single upright 11 and follow the user around. As a result, a larger fixed exercise cage or apparatus is not required.

In use, the apparatus 100 of FIG. 1 is provided. Bracket 27 is in a primary operative position engaging pin 26. The base 12, 13 is in a first operative position with the base 12, 13 fixedly contacting the floor 41 in the manner illustrated in FIG. 2. The weight of apparatus 100, which includes barbell 23, is sufficient to overcome springs 48 and force bearings 14 to 17 completely into their respective apertures 46. The construction for the spring 48, apertures 46 and 47, etc. for each bearing 15 to 17 is equivalent to the construction illustrated in FIGS. 2 and 3 for bearing 14.

Figure 7:
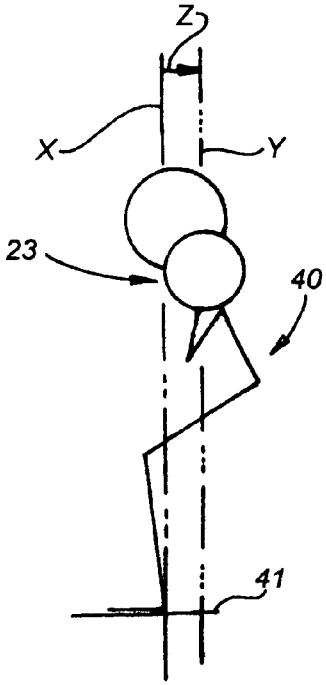
FIG. 7 is a side elevation view further illustrating an individual conducting an exercise with the apparatus of FIG. 1.

An individual 40 stands between legs 10 and 11 beneath barbell 23, grasps barbell 23, and pivots it in the direction of arrow A to disengage bracket 27 from pin 26 and, consequently, to move bracket 27 from a primary operative position to a secondary operative position. When bracket 27 is in the secondary operative position, pin 26 (and base, 12, 13) no longer bears the weight of barbell 23. This permits springs 48 to downwardly displace each bearing 14 to 17 to a position equivalent to that shown in FIG. 3. When bearings 14 to 17 are in the position illustrated in FIG. 3, base 12, 13 and legs 10, 11 are lifted off floor 41, which places base 12, 13 in a second operative position in which apparatus 100 can, due to the rotatability of bearings 14 to 17, move freely over floor 41 in any desired linear or rotational horizontally oriented direction. Even though the feet of the individual 40 may not, as is illustrated in FIGS. 4 to 7, move with respect to the original vertical axis X at which the individual is located when the individual first positions himself or herself between legs 10 and 11, the individual can utilize his hands to move freely barbell 23 (and therefore the remainder of apparatus 100) over floor 41. Such movement of the barbell 23 is advantageous because, as is illustrated in FIG. 7, during the performance of a squat the optimal position of the barbell 23 may no longer be along the original vertical axis X, but may have moved to another vertical axis Y which is a distance, indicated by arrow Z, from the original vertical axis X. In comparison, in the squat being performed in FIG. 5, the barbell must continue to move along axis X because the legs 10 and 11 of the comparable apparatus discussed above are in fixed position and can not move during performance of the exercise.

As would be appreciated by those of skill in the art, the apparatus of FIG. 1 can be utilized for exercises other than squats. For example, an individual can position a bench between legs 10 and 11 and beneath barbell 23 to perform a bench press. The individual lies face up and, after disengaging bracket 27 from a pin 26, moves the barbell 23 up and down to perform a bench press. In the event apparatus 100 is used to perform a bench press, pin 26 and stop 28 would be lowered on leg 11 to positions appropriate for performing a bench press.

Stop 28 can be shaped and dimensioned to contact and prevent the downward movement of sleeve 20, and/or can be shaped and dimensioned to contact and prevent the downward movement of barbell 23.

Figure 8:
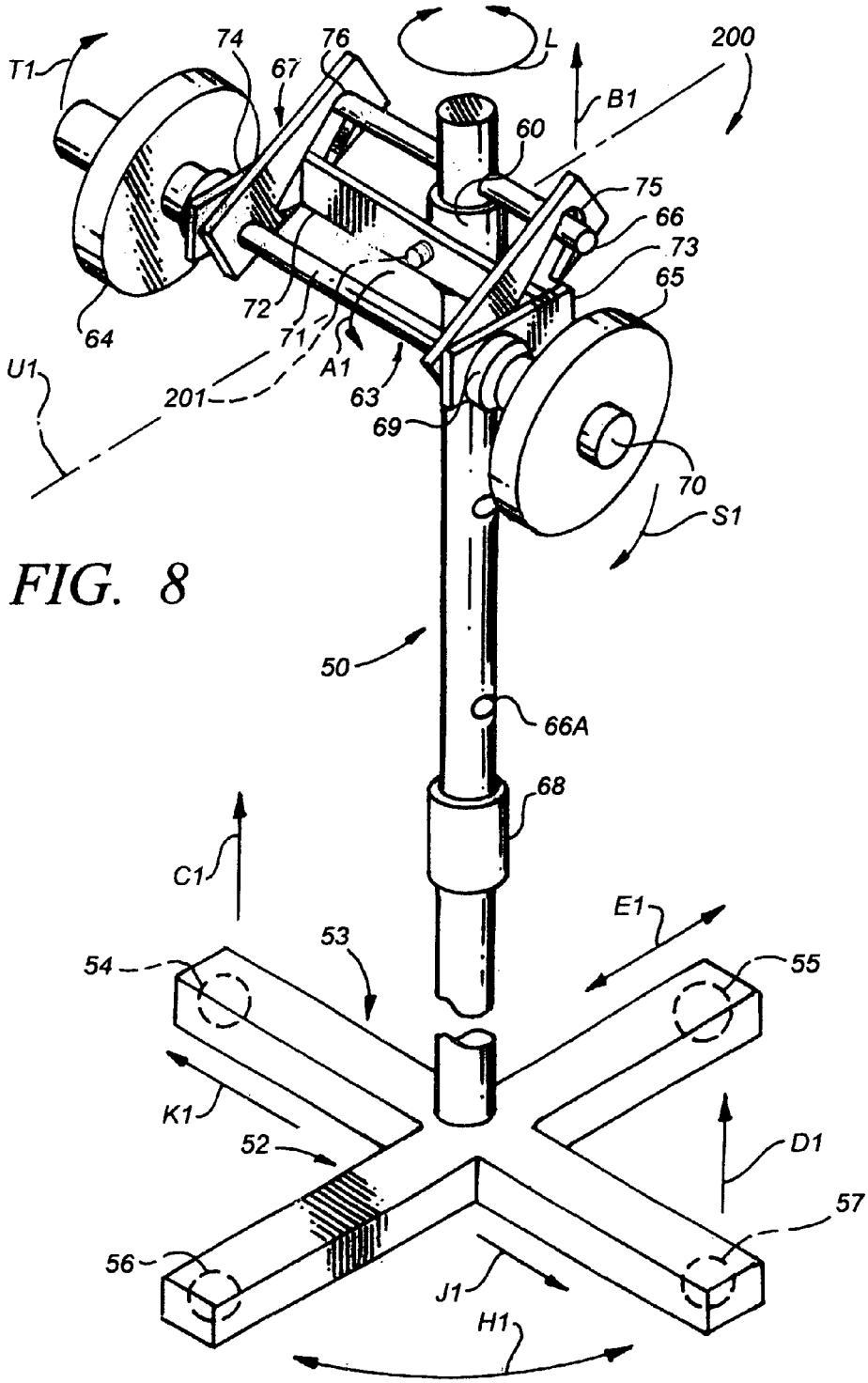
FIG. 8 is a perspective view illustrating an alternate embodiment of the invention.

FIG. 8 illustrates an exercise apparatus which is constructed in accordance with an alternate embodiment of the invention, is generally indicated by reference character 200, and includes a base including a pair of spaced apart feet 52 and 53. The base includes compressive elements comprising four spring loaded spherical bearings 54, 55, 56, 57 which when deployed roll over the floor and permit the exercise apparatus 200 to move or rotate in any desired direction. The base can have any desired shape and dimension as long as it has at least three floor engaging spherical bearings.

The lower portion of vertically oriented leg 50 includes a lower end fixedly secured to the base.

Dumbbell 63 includes handle 71. A collar 69 and rotatable sleeve 70 are mounted on each end of handle 71. Sleeve 70 and collar 69 are, in conventional fashion, free to rotate about handle 71.

Slidable sleeve 60 is slidably mounted on the upper portion of leg 50. Dumbbell 63 is fixedly secured to sleeve 60 by member 72 such that sleeve 60 and dumbbell 63 simultaneously slide upwardly or downwardly along leg 50. Handle 71 rotatably extends through parallel spaced apart members 73 and 74. Each member 73, 74 is fixedly connected to an end of rectangular member 72. Dumbbell 63 can also, if desired, rotate about leg 50 simultaneously with sleeve 60 in the manner indicated by arrows L. In FIG. 8, sleeve 60 is slidably mounted on the exterior of leg 50. As would be appreciated by those of skill in the art, sleeve 60 can, if leg 50 is hollow, be slidably mounted on the interior of leg 50, and can include a pin or other portion which extends from dumbbell 63 to the interior of leg 50 (and to the sleeve on the interior of the leg) via a longitudinal slot formed along the length of the leg 50. Consequently, as used herein, the term slidable sleeve applies to any member which is shaped and dimensioned to engage dumbbell 63 and to slide along leg 50 simultaneously with dumbbell 63. The shape and dimension of a leg 50 can similarly be varied as desired to engage a sleeve to permit the sleeve and dumbbell 63 to slide up and down along the leg.

One or more safety stops 68 can be fixedly or adjustably attached to leg 50 at desired locations along leg 50 to "catch" dumbbell 63 if a user loses control of dumbbell 63 or must lower dumbbell 63 toward the ground.

The apparatus of FIG. 8 includes a fixed support member in the form of a pin 66. The fixed support member 66 can be shaped and dimensioned as desired. The fixed support member can be permanently attached to leg 50 or can, as is the case with pin 66 in FIG. 8, be slidably inserted through an aperture in leg 50 such that the member 66 can be removed and inserted in another desired aperture 66A (FIG. 8) formed along leg 50 or can otherwise be removed and placed at another desired location along leg 50.

The apparatus of FIG. 8 includes a stabilizing apparatus in the form of a bracket assembly 67 that is fixedly mounted on rod 71 of dumbbell 63. The shape and dimension of the brackets in assembly 67 is generally comparable to that of bracket 27 in FIG. 1, except that the brackets in assembly 67 are normally longer that bracket 27. The upper ends of bracket assembly 67 include slots 75 and 76 that removably engage pin 66. When handle 71 of dumbbell 63 is grasped, upwardly displaced in the direction of arrow B1, and rotated in the direction of arrow A1, bracket 27 pivots simultaneously with dumbbell 63 in the direction of arrow A such that the slots 75 and 76 in bracket 67 lift and pivot off pin 66. When bracket 67 lifts and pivots off pin 66, dumbbell 63 is free to slide up and down along leg 50. Dumbbell 63 can slide only a short distance in the upward direction indicated by arrow B1 before sleeve 60 contacts pin 66. Dumbbell 63 can slide a greater distance in the downward direction opposite that of arrow B1.

When bracket 67 engages pin 66 in the manner illustrated in FIG. 8, the weight of dumbbell 63 is borne by pin 66 and therefore base 12 and 13 and is sufficient to maintain the base 12, 13 in contact with the floor 41 in the manner illustrated in FIG. 2 with respect to 14. The construction of bearings 54 to 57 is identical to that of roller 14 for purposes of this discussion, although, as would be appreciated by those of skill in the art, the construction of the compressive elements 14, 54 to 57 can vary as desired as long as the desired functions are achieved. When dumbbell 63 is mounted on pin 66 in the manner illustrated in FIG. 8, the weight of the dumbbell, in combination with the weight of the rest of apparatus 200, overcomes the combined expansive strength of the springs 48 operatively associated with bearings 54 to 57 and causes each bearing 54 to 57 to be pushed into its associated cylindrical aperture 46 in the manner illustrated in FIG. 2. When a bearing 54 to 57, along with its bushing—housing 43, is pushed into aperture 46, spring 48 is compressed into cylindrical aperture 47. On the other hand, when dumbbell 63 is lifted in the direction of arrow B1 and rotated in the direction of arrow A1 to disengage bracket 67 from pin 66, the weight of dumbbell 63 (and any weights 64 and 65 on the dumbbell) is no longer borne by pin 66, in which case the combined expansive strength of the springs 48 operatively associated with each spherical bearing 54 to 57 is sufficient to lift the apparatus 200 upwardly off floor 41 in the direction of arrows B1, C1, and D1 such that a portion of each spherical bearing 54 to 57 extends beneath feet 52, 53 in a manner identical to that illustrated in FIG. 3 for roller 14. When a portion of each spherical bearing 54 to 57 extends beneath feet 52 or 53 in the manner illustrated in FIG. 3, the bearings 54 to 57 and apparatus 200 can be rolled over floor 41 in any desired horizontal direction including, without limitation, the directions indicated by arrows E1, K1, and J1. Apparatus 200 can also be pivoted about a vertical axis in the manner indicated by arrows H1 in FIG. 8. Since dumbbell 63 is a part of apparatus 200, dumbbell 63 can be similarly moved in any desired horizontal direction and can be pivoted about a vertical axis X. If it is desired to fix apparatus 200 at a particular location on floor 41, dumbbell 63 is stowed on pin 66 in the position illustrated in FIG. 8. As soon as this is accomplished and pin 66, and therefore apparatus 200, is bearing the weight of dumbbell 63, springs 48 are overcome and legs 52 and 53 are downwardly displaced back into contact with the floor 41. The weight of dumbbell 63 and of apparatus 200 tends to generate frictional forces which make it difficult to slide legs 52, 53 over floor 41 when legs 52, 53 contact floor 41 in the manner illustrated in FIG. 2.

In another embodiment of the invention, member 72 is pivotally secured to sleeve 60 by a pin 201 (FIG. 8) that extends through member 72. When an individual grasps handle 71, manually upwardly lifts dumbbell 63 in the direction of arrow B1, and manually rotates handle 71 in the manner of arrow A1 to disengage bracket assembly 67 from pin 66, then member 72, and therefore dumbbell 63, is free to pivot about pin 201 (and horizontally oriented axis U1 extending through pin 201) in the manner indicated by arrows S1 and T1, and is free to pivot about pin 201 and axis U1 in directions opposite those indicated by arrows S1 and T1.

In use, the apparatus 200 of FIG. 8 is provided. Bracket 67 is in a primary operative position engaging pin 66 in the manner illustrated in FIG. 8. The legs 52, 53 are in a first operative position with the legs 52, 53 fixedly contacting the floor 41 in the manner illustrated in FIG. 2. The weight of apparatus 200, which includes dumbbell 23, is sufficient to overcome springs 48 and force bearings 54 to 57 completely into their respective apertures 46. The construction for the spring 48, apertures 46 and 47, etc. for each bearing 54 to 57 is, as noted, equivalent to the construction illustrated in FIGS. 2 and 3 for bearing 14.

An individual 40 stands adjacent leg 50, grasps rod 71 with one hand, lifts dumbbell in the direction of arrow B1, and pivots dumbbell in the direction of arrow A1 to disengage bracket 67 from pin 66, and, consequently, to move bracket 67 from a primary operative position to a secondary operative position. When bracket 67 is in the secondary operative position, pin 66 (and legs 52, 53) no longer bears the weight of dumbbell 63. This permits springs 48 to downwardly displace each bearing 54 to 57 to a position equivalent to that shown in FIG. 3. When bearings 54 to 57 are in the position illustrated in FIG. 3, legs 52 and 53 are lifted off floor 50, which places base legs 52 and 53 and apparatus 200 in a second operative position in which apparatus 200 can, due to the multi-directional rotatability of bearings 54 to 57, move freely over floor 41 in any desired linear or rotational horizontally oriented direction. The individual can utilize the hand grasping dumbbell 63 to move freely dumbbell 63 (and therefore the remainder of apparatus 200) over floor 41.

Stop 68 can be shaped and dimensioned to contact and prevent the downward movement of sleeve 60, and/or can be shaped and dimensioned to contact and prevent the downward movement of dumbbell 63.

One principal feature of the apparatus of the invention is the ability to relatively freely lift a barbell or dumbbell and to move the barbell and dumbbell in a variety of directions while still at the same time during such movement maintaining a safety stop 28 or 68 in position to catch the barbell or dumbbell if an individual finds it necessary to lower the barbell or dumbbell to the safety stop.

Figure 9:
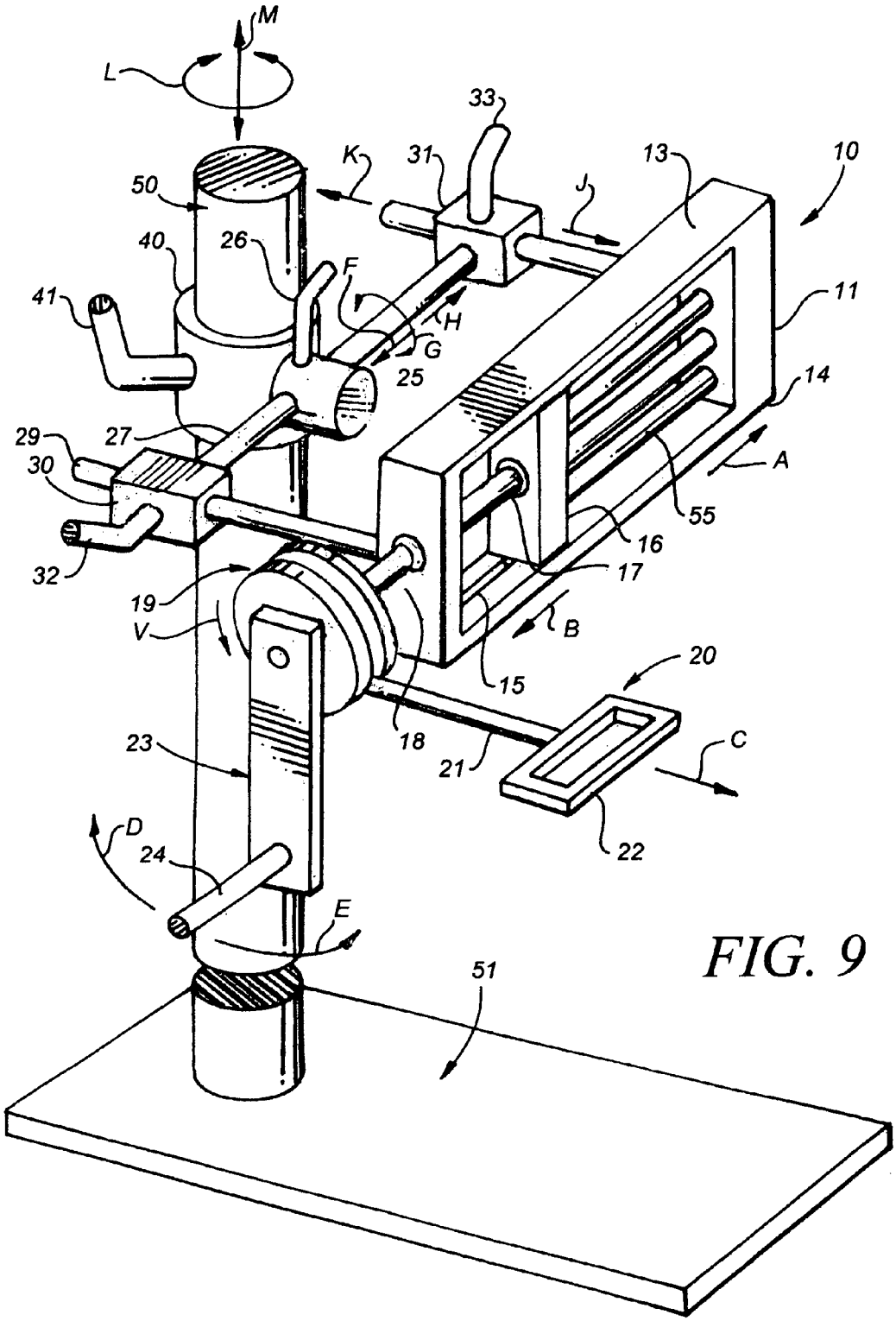
FIG. 9 is a perspective view illustrating resistance training exercise apparatus constructed in accordance with the principles of the invention.

An alternate resistance exercise apparatus constructed in accordance with the invention is illustrated in FIG. 9 and includes a ground contacting base 51. Base 51 is fixedly secured in a desired location on a floor or the ground. In another embodiment of the invention base 51 is not fixedly secured to the floor and can be moved to desired location. Base 51 can, if desired, be provided with wheels to facilitate movement of the apparatus of FIG. 9 from one location to another. Once base 51 is at a desired location on a floor, it typically is desirable to anchor or other secure base in place prior to utilizing the resistance exercise apparatus to perform an exercise. Consequently, while it is possible for base 51 to move during the performance of an exercise with the apparatus of FIG. 9, such normally is not the case. The apparatus of FIGS. 9 to 12 is herein characterized as resistance exercise apparatus because it utilizes deformable components like elastic straps 55 to produce resistance during the performance of an exercise.

Cylindrical support member 50 upwardly depends from base 51. As would be appreciated by those of skill in the art, the shape and dimension of member 50 and other structural components of the invention can vary as desired as long as the necessary functions performed by such components is achieved. Hollow cylindrical sleeve 40 can, when set screw 41 is loosened, rotate about member 50 in the directions indicated by arrows L, and, can slide up and down member 50 in the directions indicated by arrows M. Set screw 41 is tightened against member 50 to secure sleeve 40 in place on member 50. As would be appreciated by those of skill in the art, quick release pins or other adjustable or removable fastening members can be utilized in combination with or in place of set screw 41.

Cylindrical support member 25 is fixedly secured to and outwardly depends from hollow cylindrical sleeve 40.

Cylindrical shaft 27 slidably extends through a cylindrical aperture formed completely through cylindrical support member 25. Shaft 27 can, when set screw 26 is loosened, slide through member 25 in the directions indicated by arrows H, and, rotate in member 25 in the directions indicated by arrows G. Set screw 26 is tightened against shaft 27 to secure shaft 27 in place in member 25.

One end of cylindrical shaft 27 is fixedly secured to block 31. The other end of cylindrical shaft 27 is fixed secured to block 30. A cylindrical aperture formed completely through block 31 slidably receives the distal end of cylindrical arm 28 such that the distal end of arm 28 can, when set screw 33 is loosened, slide through block 31 in the directions indicated by arrows J and K. A cylindrical aperture formed completely through block 30 slidably receives the distal end of cylindrical arm 29 such that the distal end of arm 29 can, when set screw 32 is loosened, slide through block 30 in the directions indicated by arrows J and K. In use, set screws 32 and 33 ordinarily are loosened at the same time such that arm 28 slides through block 31 at the same time that arm 29 slides through block 30. Set screw 32 is tightened against shaft 29 to secure shaft 29 in block 30. Set screw 33 is tightened against shaft 28 to secure shaft 28 in block 31.

The proximate end of arm 28 is fixedly removably connected to stationary support 11 of hollow orthogonal housing 10. The proximate end of arm 29 is fixedly removably connected to stationary support 12 of hollow orthogonal housing 10. Top member 13 of orthogonal housing 10 extends between and fixedly interconnects supports 11 and 12. Bottom member 14 of orthogonal housing 10 extends between and fixedly interconnects supports 11 and 12. Members 13 and 14 are parallel, as are supports 11 and 12. Movable support 16 of housing 10 extends and slides between members 13 and 14 in the directions indicated by arrows A and B. Support 16 is normal to the longitudinal axes of members 13 and 14.

Housing 10 also includes elastic members 55. One end of each elastic member 55 is fixedly removably attached to support 11; the other end of each elastic member 55 is fixedly removably attached to support 16. The longitudinal axis of each elastic member 55 is parallel to the longitudinal axes of cylindrical shaft 18 and members 13 and 14, although this need not be the case.

Housing 10 also includes rotatable shaft 18 with externally threaded distal end 17; includes spool 19; includes arm 23 with handle 24; and includes handle 22 connected to cable 21. The externally threaded distal end 17 of shaft 18 engages an internally threaded bushing mounted in support 16 such that rotating shaft 18 in one direction displaces support 16 in the direction of arrow A and rotating shaft 18 in the opposite direction displaces support 16 in the direction of arrow B. For example, pulling handle 22 of band unit 20 in the direction of arrow C, rotates spool 19 (and therefore shaft 18) in a counterclockwise direction V which displaces support 16 in the direction of arrow B. Similarly, grasping handle 24 and pulling arm 23 in the direction of arrow E also rotates spool 19 in a counterclockwise direction which simultaneously turns threaded end 17 into support 16 and pulls and displaces support 16 in the direction of arrow B. Shaft 18 is fixedly secured to and rotates simultaneously with spool 19. Displacing support 16 in the direction of arrow B slides support 16 between stationary top and bottom members 13, 14, respectively. A nub on the bottom of support 16 extends into groove 15. The nub and groove 15 function collectively to guide support 16 as it travels back and forth between members 13 and 14.

When handle 22 is pulled in the direction of arrow C, cord or cable 21 unspools from spool 19. Pulling handle 22 in the direction of arrow C functions, as noted above, to displace support 16 in the direction of arrow B. When support 16 moves in the direction of arrow B, elastic bands 55 stretch which increases the resistance provided by bands 55.

Reducing the tension on handle 22 after it is pulled a desired distance in the direction of arrow C reduces the extension forces acting on bands 55 and permits them to contract and pull support 16 in the direction of arrow A, which turns shaft 18 and spool 19 in a clockwise direction opposite the direction indicated by arrow V.

Reducing the tension on handle 24 after it is pulled a desired distance along the arc in the direction indicated by arrow E reduces the extension forces acting on bands 55, permits handle 24 to move in a direction indicated by arrow D, and permits the distended bands 55 to contract and support 16 in the direction of arrow A, which turns shaft 18 and spool 19 in a clockwise direction opposite the direction indicated by arrow E. Alternatively, handle 24 can be manually moved in the direction of arrow E.

Figure 10:
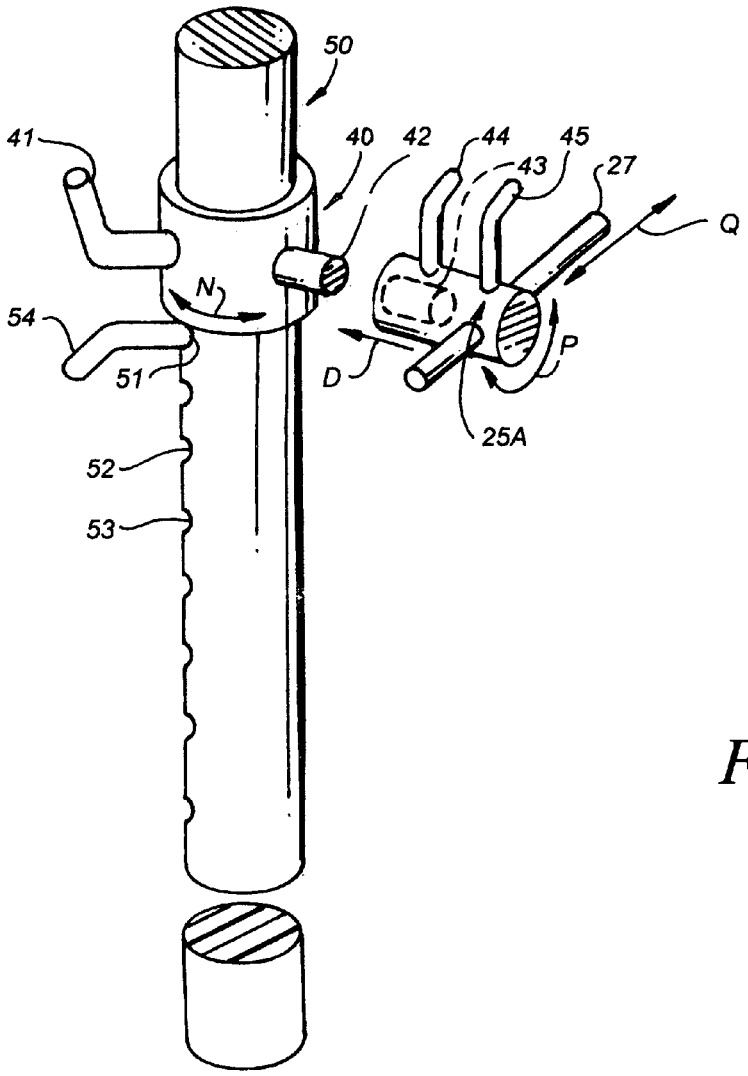
FIG. 10 is a partial perspective view illustrating an alternate embodiment of the resistance training apparatus of the invention.

FIG. 10 illustrates an alternate embodiment of the apparatus of FIG. 9. The apparatus of FIG. 10 is equivalent to that of FIG. 9 except member 25A and set screws 44 and 45 are substituted for member 25 and set screw 26; pin 42 is affixed to collar 40; apertures 51, 52, 53 are formed in support 50; and, quick release pin 54 is provided for insertion in and removal from selected ones of apertures 51, 52, 53. Each aperture 51, 52, 53 is shaped and dimensioned to receive removably quick release pin 54. In FIG. 10, housing 10, arms 28 and 29, blocks 30 and 31, and set screws 32 and 33 are, for the sake of clarity, omitted, as are the ends of arm 27. The intermediate portion of arm 27 is, however, depicted in FIG. 9. When quick release pin 54 is removably inserted in an aperture 51, when sleeve 40 rests on pin 54 in the manner illustrated in FIG. 10, and when set screw 41 is loosened, then sleeve 40 can rotate about support 50 in the manner indicated by arrows N. When sleeve 40 rotates about support 50 in the manner indicated by arrows N, the bottom edge of sleeve 40 slides over pin 54, and pin 54 prevents sleeve 40 from sliding down support member 50.

Member 25A includes aperture 43 which slides over pin 42 in the direction of arrow O to mount member 25A on pin 42. After member 25A is mounted on pin 42, member 25A (and therefore housing 10) can be rotated about pin 42 in the manner indicated by arrows P. Once member 25A is rotated about pin 42 to a desired orientation, set screw 44 is then tightened against pin 42 to secure member 25A on pin 42 in said desired orientation.

Arm 27 slidably rotatably extends through a cylindrical aperture which extends completely through member 25A. When set screw 45 is loosened, arm 27 can slide through the cylindrical aperture in member 25A and (simultaneously with housing 10) move in the directions indicated by arrows C), and can also (simultaneously with housing 10) rotate about the longitudinal axis of arm 27. Set screw 45 is tightened against arm 27 to secure arm 27 in fixed position in member 25A. If arm 27 and the aperture which is formed through member 25A and slidably receives arm 27 are shaped and dimensioned to have a square cross section or other non-circular cross section, then arm 27 will not, of course, rotate about the longitudinal axis of arm 27.

Figure 11:
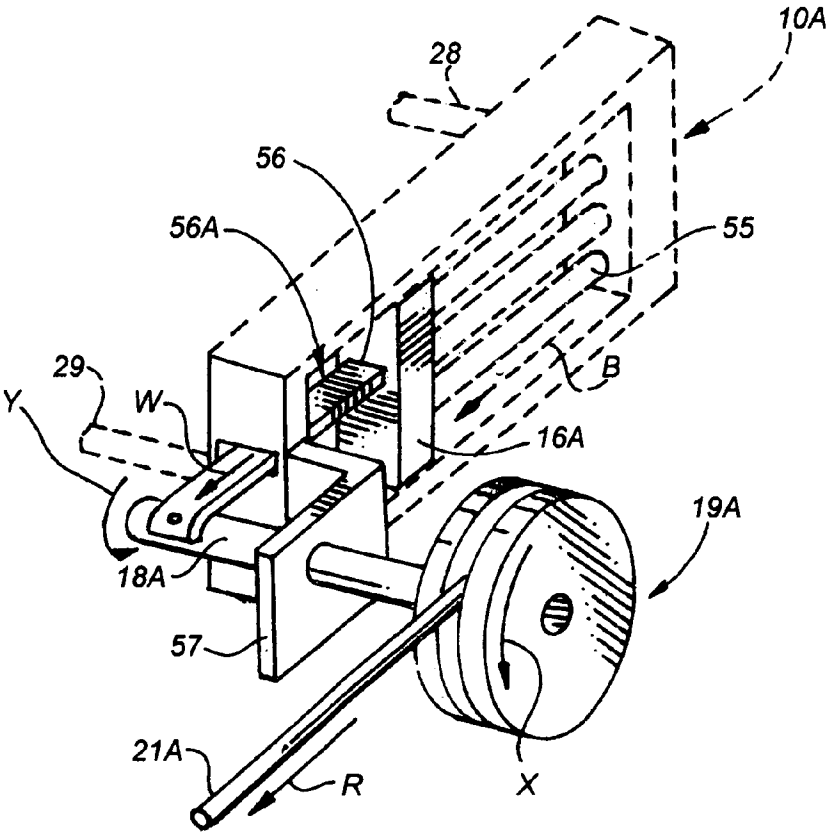
FIG. 11 is a partial section view illustrating another embodiment of the resistance training apparatus of the invention; and, FIG. 12 is a perspective view illustrating the mode of operation of the apparatus of FIG. 9.

The alternate embodiment of the invention illustrated in FIG. 11 includes a housing 10A which is similar to housing 10 in that it includes an orthogonal frame with side members and top and bottom members comparable to side 11 and 12 and top and bottom members 13 and 14, includes elastic members 55, and includes a movable support 16A which slides intermediate top and bottom members 13 and 14 and is comparable in structure and function to support 16 in FIG. 9. Instead, however, of being moved by a shaft 18 with an externally threaded end (as is support 16), support 16A is moved in the direction of arrow B by a strap 56A having one end 56 fixedly secured to support 16A and the other end secured to a rotatable shaft 18A. Shaft 18 is rotatably mounted in L-shaped support member 57 and is fixedly secured to spool 19A. Member 57 is fixedly secured to housing 10A. Rotating spool 19A in the direction of arrow R causes shaft 18A to rotate simultaneously with spool 19A, causes one end of strap to wrap around shaft 18A, and causes strap 56A and support 16A to move in the direction of arrow W. Moving support 16A in the direction of arrow W stretches and increases the resistance produced by elastic members 55. Pulling in the direction of arrow R a cable 21A which is wound on spool 19A causes spool 19A to rotate in the direction of arrow X, causes shaft 18A to rotate in the manner indicated by arrow Y, and wraps one end of strap 56A about shaft 18A.

Figure 12:
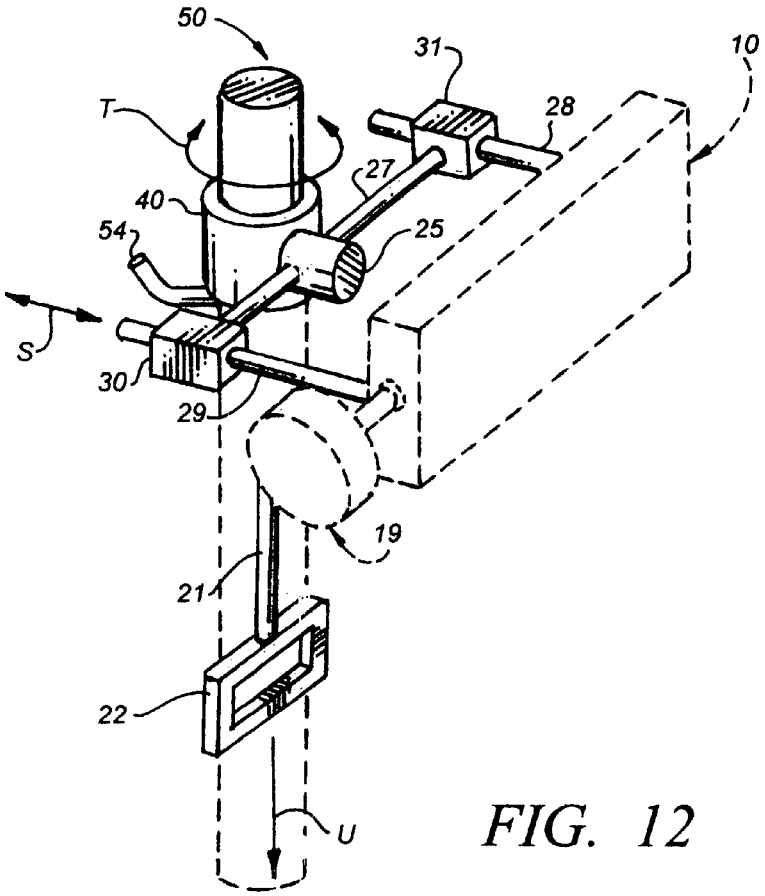

FIG. 12 illustrates one method of using the apparatus of FIG. 9. In FIG. 12, set screws 32 and 33 are omitted for the sake of clarity. Shafts 28 and 29 are free to slide through blocks 30 and 31 in the directions indicated by arrow S. Similarly, set screw 41 is omitted, and hollow sleeve 40 is free to rotate about member 50 in the directions indicated by arrows T. Pin 54 supports sleeve 40 and prevents sleeve 40 from sliding down member 50 toward the ground. The lower edge of sleeve 40 can, however, freely slidably rotate over pin 54 in the directions indicated by arrows T. Shaft 27 is fixedly secured in member 25, although this need not be the case. The ability of sleeve 40 to rotate about member 50, and the ability of shafts 28 and 29 to slide back and forth in blocks 31 and 30 permits housing 10 to float such that the orientation and position of housing 10 with respect to member 50 and to an individual utilizing the apparatus of FIG. 9 can vary. This ability of housing 10 to float enables the apparatus to simulate to a certain extent the feel experienced by an individual who utilizes a free weight. When a free weight is being utilized-during an exercise, an individual can more readily adjust the position of his body with respect to the free weight and vice-versa. If an individual is utilizing the apparatus depicted in FIG. 12 by grasping and pulling handle 22 in the direction of arrow U, housing 10 is free to move in the directions indicated by arrows S and T and during performance of this exercise to change the position of housing 10 with respect to member 50. For example, an individual lies back-down on a mat on the floor, with his head adjacent support 50 and his torso and legs extending away from support 50 in the same direction that housing 10 extends away from support 50. He positions his upper left arm on the mat, parallel to the floor. While maintaining his upper left arm on the mat, he bends his left forearm upwardly and positions his forearm perpendicular to the mat and to the floor. He grasps handle 22 with his left hand and begins to perform a bicep curl by moving his hand and handle 22 toward his left shoulder. As he moves his hand toward his left shoulder, one of the forces generated is a force that is parallel to the floor and acts to displace housing 10 from the position illustrated in FIG. 12 toward support 50. Since shafts 28 and 29 are free to slide through blocks 31 and 30, respectively, they do so and housing 10 and shafts 28 and 29 slidably move toward support 50. This ability of housing 10 to adjust its position with respect to member 50 during an exercise enables of apparatus of FIG. 9 to mimic to a certain extent a free weight. When an individual lifts a free weight, the individual can readily adjust the position of the weight and/or of his body during the performance of the exercise. This ability to adjust the position of the free weight helps to compensate for changes in the position of the individual's body and reduces the risk of injury to the individual. Accordingly, the ability of housing 10 to "float" during an exercise is believed to reduce the risk of injury to an individual, and to train balance, coordination, and stabilizing muscles, as well as primary muscles. For example, during a curl the biceps are the primary muscles and the shoulder muscles are among the stabilizing muscles. Another virtual of the invention, however, is that housing 10 need not be free to move during an exercise but can instead be maintained in fixed position, which is desirable during some exercises. The particular set screws 26, 32, 33, 41 which are selected to be loosened or tightened prior to performing an exercise can vary as desired.

In the embodiments of the invention illustrated in FIGS. 9 to 12, when spool 19, 19A is turned, the resistance of the exercise apparatus is increased by moving support 16, 16A in the direction of arrow B (FIGS. 9, 11) to stretch an elastic band 55 or spring. As would be appreciated by those of skill in art, an alternate embodiment of the invention can be used in which support 16, 16A is moved in the direction of arrow A (FIG. 9) to increase the resistance of the exercise apparatus by compressing an elastic member or spring.

In one alternate embodiment of the invention, resistance exercise housing 10 is removed from support member 50 for transport or to be utilized separately from member 50 by securing housing 10 to the floor, to a table, to a door frame, or to another desired support member. Such use of resistance exercise housing 10 separate from member 50 can, if desired, be facilitated by removing shafts 28 and 29 (and therefore shaft 27, blocks 30, 31, member 25, sleeve 40, etc.) from housing 10. The preferred portable resistance exercise unit of the invention presently comprises housing 10, 10A in configurations comparable to those illustrated in FIGS. 9 and 11. Any desired mounting system can be utilized to secure such a resistance exercise unit to a desired support member. Such a mounting system may, or may not, include shafts 28 and 29 and the various other mounting components otherwise illustrated in the drawings.

A second apparatus that is identical or similar to the apparatus of FIG. 9 can be utilized in combination with the apparatus of FIG. 9. For example, if a like pair of the FIG. 9 apparatus are provided, are each in the configuration illustrated in FIG. 12, and are spaced apart such that the handles 22 are about shoulder width apart, then an individual positioned on his back beneath handles 22, can hold one handle 22 of one of the like pair apparatus with his right hand, hold the handle 22 of the other of the like pair apparatus with his left hand, and pull the handles 22 simultaneously in the direction of arrow U (FIG. 12) with his left and right hands.

In another possible configuration in accordance with the invention, a pair of the FIG. 9 apparatus are provided, except that the handle 20 on each apparatus comprises a circular ring instead of the orthogonal handle illustrated in FIG. 9. Each of the pair of FIG. 9 apparatus is in the general configuration illustration in FIG. 9 with housing members 11 and 12 perpendicular to the floor. The pair of apparatus are spaced apart such that the housing 10 of the first apparatus is aligned with and in the same vertical plane as the housing 10 of the second apparatus, and, such that the handle 20 of one apparatus is spaced apart from the handle 20 of the other apparatus a distance which is a few inches greater than the shoulder width of the individual utilizing the apparatus. The steel bar of a barbell is, without weights on either end of the bar, extended through the circular rings comprising the handles 20. The individual, while standing, grasps the bar at point intermediate the handles 20 and performs a curl. During the last half of the curl, the user's forearms are initially parallel to the floor. Consequently, during the last half of the curl, the cable 21 attached to each handle 20 is pulled outwardly from spool 19 in the direction of arrow C, and is also pulled upwardly away from the floor as the user's hands move upwardly away from the floor and toward the user's shoulders.

As would be appreciated by those of skill in the art, the distance that a support 16, 16A is displaced is less than the distance that a cable 21, 21A is moved to turn a spool 19, 19A to produce such a displacement. Accordingly, the amount by which a spool 19, 19A must be rotated to produce a desired displacement of a support 16, 16A is much greater than if an individual were pulling directly on a support 16, 16A or on an elastic strap 55. In contrast, if an individual were to manually grasp and pull a strap 55 (or a handle directly attached to strap 55), the distance the strap 55 is distended would equal the distance that the individual's hand travels. The diameter of spool 19, 19A is preferably significantly greater than the diameter of its operatively associated shaft 18, 18A.

A particular advantage of the invention is that the amount by which an elastic strap 55 is distended (or compressed) during an exercise is minimized, which extends the operational life of strap 55. Utilizing multiple straps 55 also reduces the amount by which each strap 55 must be distended (or compressed) to produce a desired increase in resistance during an exercise. Although the size of the various structural components utilized in the exercise apparatus of the invention can vary as desired, utilizing multiple straps and minimizing the amount by which a strap is distended during use of the apparatus of the invention, also tends to decrease the necessary length of a strap. Accordingly, elastic extendible straps 55 or springs and elastic compressible straps or springs typically preferably each have an "at rest", untensioned length in the range of eight inches to thirty-six inches, preferably twelve to twenty-four inches. This enables apparatus of the invention to be lightweight and compact. The length of top and bottom members 13 and 14 typically is in the range of eight inches to fifty inches, preferably twelve to thirty-six inches. The length of sides 11 and 12 typically is in the range of four inches to thirty inches, preferably six to twenty-four inches. The overall length of a resistance exercise unit from spool 19 to the far side 11 of housing 10 typically is in the range of fourteen inches to fifty-five inches. The diameter of a spool 19 typically is in the range of three inches to twelve inches. During use of the exercise apparatus, straps 55 are stretched or compressed no more than 25%, preferably 20%, more preferably 15%, and most preferably 10%, of their untensioned length. For example, with an elastic 55 that is twenty-four inches in length, the change in length during an exercise might be three inches. In contrast, during the same exercise the range of motion experienced by the user while pulling handle 20 might be thirty inches. In other words, the handle 20 might move away from the spool 19 by thirty inches during the exercise. The distance the handle 20 moves is much greater than the amount by which strap 55 is stretched.

Another advantage of the exercise apparatus of the invention is that it can be used both for linear (i.e., handle 22 and cable 21) or rotational (i.e., handle 24 and arm 23) movements.

The resistance exercise apparatus of the invention is distinguishable from conventional "weight stack" machines both because the resistance exercise apparatus is portable and readily transportable and because "weight stack" machines rely on gravitational resistance. Further, housing 10 can be readily repositioned at selected varying heights above the ground. The resistance produced by strap 55 depends only minimally, if at all, on resistance produced by gravity acting on a machine component.

Another advantage of the resistance exercise apparatus of the invention is that it simplifies the elastic band apparatus required to conduct an exercise. In particular, the construction of housing 10 is relatively simple and facilitates the repositioning housing 10 on the apparatus of FIG. 9, and, facilitates the ability of housing 10 to be removed from the apparatus of FIG. 9 and to be transported to and utilized at a separate location. In particular, moving housing 10 simplifies configuring the apparatus to perform different exercises. For example, housing 10 can, without requiring the length of cable 21 initially extending from spool 19 to be altered, first be positioned closer to the floor and used to pull up handle 20, and then be positioned at higher elevation to pull down handle 20 during an exercise.

The apparatus of FIGS. 1 to 8 also provides a simplified exercise apparatus in that the four upright supports required in a Smith machine are not required in the apparatus of FIGS. 1 to 8. Further the apparatus of FIGS. 1 to 8 can be adjusted and configured in ways not possible in a Smith machine to provide a variety of exercises including those which require rotational movement.

Having described the invention and presently preferred embodiments and the best modes thereof in such terms as to enable one of skill in the art to make and use the invention, I claim:

1. A method in which an individual dynamically positions resistance training apparatus during an exercise to facilitate proper exercise technique and reduce the risk of injury, comprising the steps in which the individual (a) provides an exercise apparatus including (i) a base at a first location, (ii) at least one structural support member secured to said base at said first location, (iii) a portable resistance unit at a second location and comprising a housing including, a first stationary support, a second movable support spaced apart from said first stationary support, a plurality of elastic members mounted in said housing and each including a first end attached to said first stationary support and a second end attached to said second movable support, a rotatable shaft having a first diameter and connected to said second movable support such that rotation of said shaft displaces said second movable support member to change the length of and alter the resistance produced by said plurality of elastic members, a rotatable cylindrical spool mounted on said rotatable shaft and having a second diameter greater than said first diameter, a manually operable handle connected to said cylindrical spool and displaceable to rotate said spool and said shaft simultaneously to move said second movable support;

(b) provides a mounting system to interconnect said resistance unit and support member to permit said resistance unit to move between at least two operative positions during the performance of an exercise, a first operative position with said resistance unit in a first initial orientation with respect to said support member, and a second operative position with said resistance unit in a second orientation with respect to said support member, said second orientation different from said initial orientation;

(c) transports said resistance unit from said second location to said first location;

(d) utilizes said mounting system to interconnect said portable resistance unit and support member to permit said resistance unit to move between said two operative positions during the performance of an exercise; and, (e) performs an exercise during which said resistance unit moves between said first and second operative positions.

2. The method of claim 1 wherein (a) said base comprises a floor; and, (b) said structural support member comprises a wall upwardly extending from said floor.

3. The method of claim 1 wherein (a) said base member comprises the ground; and, (b) said structural support member comprises a floor constructed on said ground.

4. The method of claim 1 wherein after step (e) the individual (a) removes said portable resistance unit from said support member; and, (b) moves said resistance unit from said first location to a third location and performs an exercise at said third location with said resistance unit.

5. A method in which an individual repositions resistance training apparatus prior to performing an exercise to facilitate proper exercise technique, comprising the steps in which the individual (a) provides an exercise apparatus including (i) a base at a first location, (ii) at least one structural support member secured to said base at said first location, (iii) a portable resistance unit at a second location and comprising a housing including, a first stationary support, a second movable support spaced apart from said first stationary support, a plurality of elastic members mounted in said housing and each including a first end attached to said first stationary support and a second end attached to said second movable support, a rotatable shaft having a first diameter and connected to said second movable support such that rotation of said shaft displaces said second movable support member to change the length of and alter the resistance produced by said plurality of elastic members, a rotatable cylindrical spool mounted on said rotatable shaft and having a second diameter greater than said first diameter, a manually operable handle connected to said cylindrical spool and displaceable to rotate said spool and said shaft simultaneously to move said second movable support;

(b) provides a mounting system to interconnect said resistance unit and support member;

(c) transports said resistance unit from said second location to said first location;

(d) utilizes said mounting system to interconnect said portable resistance unit and support member; and, (e) performs an exercise utilizing said resistance unit at said second location.

* * * * *